US005497908A

United States Patent [19]

Cheek,III et al.

[11] Patent Number: 5,497,908

[45] Date of Patent: Mar. 12, 1996

[54] CREASE KEEPER

[76] Inventors: Robert B. Cheek,III, 67 Beacon Hill Ter., Shelton, Conn. 06484; Albert E. Cheek, 5712 Long Iron Dr. #237, Orlando, Fla. 32839

[21] Appl. No.: 293,044

[22] Filed: Aug. 19, 1994

[51] Int. Cl.[6] ..... D06C 15/00

[52] U.S. Cl. ..... 223/74; 223/72; 223/95

[58] Field of Search ..... 223/72, 73, 74, 223/75, 76, 77, 85, 95, 96, DIG 1; 38/70, 102; 403/206, 207, 407.1; 267/179, 174, 175; D6/315, 316

[56] References Cited

U.S. PATENT DOCUMENTS

| | | | |
|---|---|---|---|
| 830,874 | 9/1906 | Bedinger | 223/85 |
| 988,504 | 4/1911 | Donnell et al. | 38/102.8 |
| 1,342,265 | 6/1920 | Johnson | 223/96 |
| 1,598,480 | 8/1926 | Deal | 267/179 |
| 2,393,263 | 1/1946 | Puzio, Jr. | 223/95 |
| 2,553,116 | 5/1951 | Simons | 223/95 |
| 3,972,455 | 8/1976 | Collins | 223/96 |
| 4,403,561 | 9/1983 | Schaeflern | 267/179 |
| 4,709,838 | 12/1987 | Campbell | 223/DIG. 1 |

*Primary Examiner*—C. D. Crowder
*Assistant Examiner*—Bibhu Mohanty

[57] ABSTRACT

A crease keeper for maintaining trouser creases and mitigate wrinkling including a pair of spring loaded trouser leg expanders hung from a support system having a hook for hanging the entire assembly with trousers attached in a closet or other location. One embodiment employs a wire-like frame having coil spring cartridges affixed thereto providing crease maintenance forces tending to stretching trouser legs. An alternate embodiment employs a wirelike frame having a first and second portion thereof formed into springs providing crease maintenance forces.

5 Claims, 4 Drawing Sheets

CREASE KEEPER

BACKGROUND OF THE INVENTION

1. Field of the Invention

The present invention relates to garment hangers and more particularly pertains to a crease keeper which may be employed to maintain a crease and wrinkle free disposition of trousers disposed thereon.

2. Description of the Prior Art

The use of garment hangers is known in the prior art. More specifically, garment hangers heretofore devised and utilized for hanging trousers and mitigating the formation of creases therein are known to consist basically of familiar, expected and obvious structural configurations, notwithstanding the myriad of designs encompassed by the crowded prior art which have been developed for the fulfillment of countless objectives and requirements.

The present invention is directed to improving devices for a crease keeper in a manner which is safe, secure, economical and aesthetically pleasing.

For example, U.S. Pat. No. 4,746,040 to Hazenveld discloses a trouser hanger comprising a tensioning member having two opposing tensioning arms which apply tensile force in continuum to the waistband of trousers hanging thereon. The Hazenveld invention has no provision for maintaining a crease in trousers by application of crease maintenance forces along the entire leg portion of the trouser. The present invention comprises a framework which applies substantially uniplanar multidirectional tensile force in trousers along each entire leg lengths and furthermore provides for hanging the garments so held.

In U.S. Pat. No. 3,739,959 to Gordon a device for retaining trouser-legs in position while being machine ironed is disclosed. The Gordon invention comprises a pair of spring loaded overlapping thin plates which transmit ironing force from ironing cushions of an ironing machine to trouser legs. The Gordon invention is employed for disposition of trousers during machine ironing and is not generally intended for storage or non-iron induced crease depletion. The present invention comprises a framework which acts as a trouser hanger and crease remover wherein trousers so hung are maintained crease free until use.

In U.S. Pat. No. 4,729,498 to Blanchard a telescopic garment hanger is described. The Blanchard invention comprises a garment hanger for hanging garments from a waistband. The present invention hangs trouserlike garments by disposition of expanding frameworks within the legs thereof and thereby stretchedly removes wrinkles and creases in the fabric thereof.

In U.S. Pat. No. 4,311,260 to Toy a garment display rack is disclosed for displaying a trouser pair in a selected position. The Toy invention comprises a pair of leg frame members in a side by side spaced relationship wherein each leg frame member comprises a plurality of pairs of elongated elements. A disadvantage in this prior art lies in a variety of positions available for the trouser legs some of which will produce fabric wrinkles or multiple creases therein and many positions are suited solely for marketing purposes. The present invention employs a trouser leg disposed singular pair of elongated elements precluding positioning the leg portions in a variety of dispositions and furthermore is devised to maintain the trouser leg portions free of wrinkles while emphasizing a preferred crease thereof.

U.S. Pat. No. 4,593,839 to Vandoros discloses a garment stretcher. The disclosure teaches an apparatus and method for stretching a localized area of a garment employing a pair of pads and screws which are operated to forcibly expand against garment restoring forces. The disclosure makes no provision for stretchably straightening a large area of a garment such as a trouser leg pair. Furthermore, there are no provisions for maintaining a crease in trouser legs. The present invention comprises an expandable framework and hanger maintaining a crease in trouser legs and smoothing wrinkled areas by slight stretching applied in continuum.

In this respect, the crease keeper according to the present invention substantially departs from the conventional concepts and designs of the prior art, and in so doing provides an apparatus primarily developed for the purpose of maintaining a crease in trousers and reducing wrinkling thereto as introduced by ordinary and extraordinary wear and storage.

Therefore, it can be appreciated that there exists a continuing need for new and improved crease keeper which can be employed to maintain a crease in trousers and remove wrinkles thereto. In this regard, the present invention substantially fulfills this need.

As illustrated by the background art, efforts are continuously being made in an attempt to improve trouser hangers and trouser pressing devices. No prior effort, however, provides the benefits attendant with the present invention. Additionally, the prior patents and commercial techniques do not suggest the present inventive combination of component elements arranged and configured as disclosed and claimed herein.

The present invention achieves its intended purposes, objects, and advantages through a new, useful and unobvious combination of method steps and component elements, with the use of a minimum number of functioning parts, at a reasonable cost to manufacture, and by employing only readily available materials.

SUMMARY OF THE INVENTION

In view of the foregoing disadvantages inherent in the known types of trouser hangers and crease preservers now present in the prior art, the present invention provides an improved crease keeper construction wherein the same can be utilized for maintaining a trouser crease and removing wrinkles therefrom. As such, the general purpose of the present invention, which will be described subsequently in greater detail, is to provide a new and improved crease keeper apparatus and method which has all the advantages of the prior art trouser hangers and crease preservers and none of the disadvantages.

The invention is defined by the appended claims with the specific embodiment shown in the attached drawings. For the purpose of summarizing the invention, the invention may be incorporated into a pair of elongated spring loaded wirelike frames loosely joined at an upper portion thereof by a wirelike member having a hooklike hanger disposed thereon for the purpose of hanging the entire assembly upon an existing hook or bar. The spring loaded wirelike frames apply force to an opposing pair of wirelike members which transmit the force to opposing linear portions interior to a trouser leg thereby producing a pressure which lies substantially along an existing trouser leg crease.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In as much as the foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the disclosed specific methods and structures may be readily utilized as a basis for modifying or designing other structures for carrying out the same purposes of the present invention. It should be realized by those skilled in the art that such equivalent methods and structures do not depart from the spirit and scope of the invention as set forth in the appended claims.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

Therefore, it is an object of the present invention to provide an improved crease keeper which maintains a crease in trouser legs and aids in removing wrinkles therefrom.

It is therefore an additional object of the present invention to provide a new and improved crease keeper which has all the advantages of the prior art trouser hangers and crease preservers and none of the disadvantages.

It is another object of the present invention to provide a new and improved crease keeper which may be easily and efficiently manufactured and marketed.

It is a further object of the present invention to provide a new and improved crease keeper which is of a durable and reliable construction.

An even further object of the present invention is to provide a new and improved crease keeper which is susceptible of a low cost of manufacture with regard to both materials and labor, and which accordingly is then susceptible of low prices of sale to the consuming public, thereby making such crease keepers economically available to the buying public.

Still yet another object of the present invention is to provide a new and improved crease keeper which provides in the apparatuses and methods of the prior art some of the advantages thereof, while simultaneously overcoming some of the disadvantages normally associated therewith.

Still another object of the present invention is to provide a new and improved crease keeper being light in weight and susceptible to folding for storage.

Yet another object of the present invention is to provide a new and improved crease keeper capable of fitting a variety of trouser sizes.

Even still another object of the present invention is to provide a new and improved crease keeper which may remove a substantial number of wrinkles in trousers and furthermore be a potential alternative to hot pad pressing.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention. The foregoing has outlined some of the more pertinent objects of this invention. These objects should be construed to be merely illustrative of some of the more prominent features and applications of the present invention. Many other beneficial results can be attained by applying the disclosed invention in a different manner or by modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
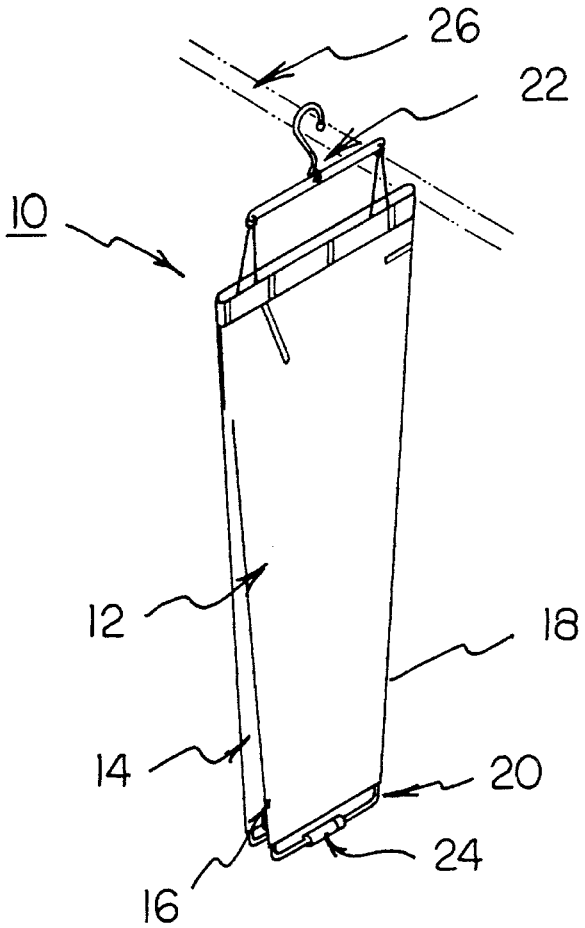
FIG. 1 is a perspective view of the crease keeper showing the disposition of trousers thereon.

With reference now to the drawings, and in particular to FIG. 1 thereof, a new and improved crease keeper embodying the principles and concepts of the present invention and generally designated by the reference numeral 10 will be described.

From an overview standpoint, the crease keeper is adapted for use with trouserlike garments 12 for the purpose of maintaining creases 14 generally upon the front 16 and rear 18 portion of each leg of trouserlike garment 12. See FIG. 1. The crease keeper 10 comprises a wirelike frame 20, a hanger 22, and a plurality of spring loading members 24. Hanger 22 engages rodlike bar 26 thereby permitting hanging of one or more trouserlike garments 12 thereupon.

Figure 2:
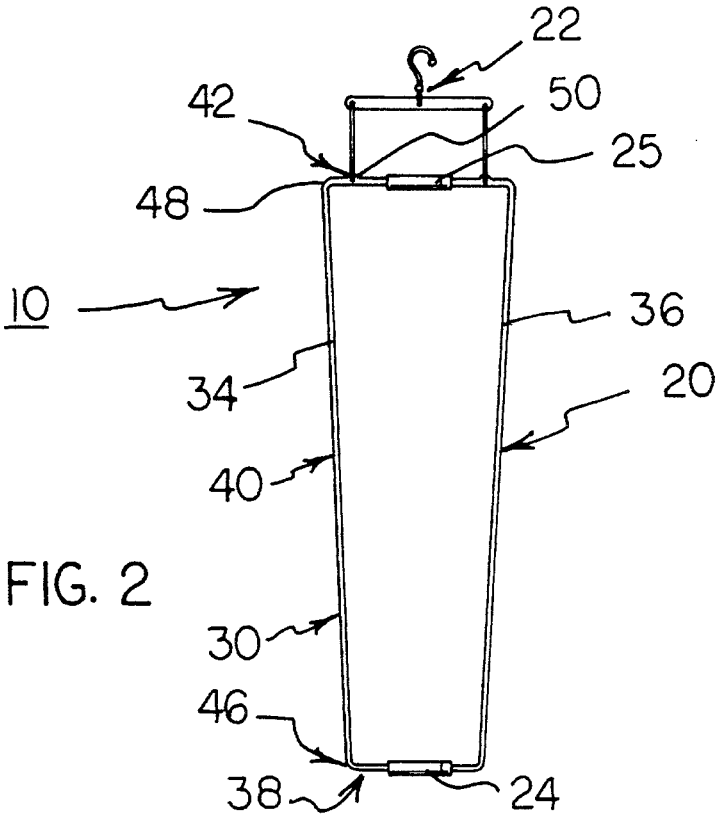
FIG. 2 is a side elevational view of the crease keeper in a hanging position.
Figure 3:
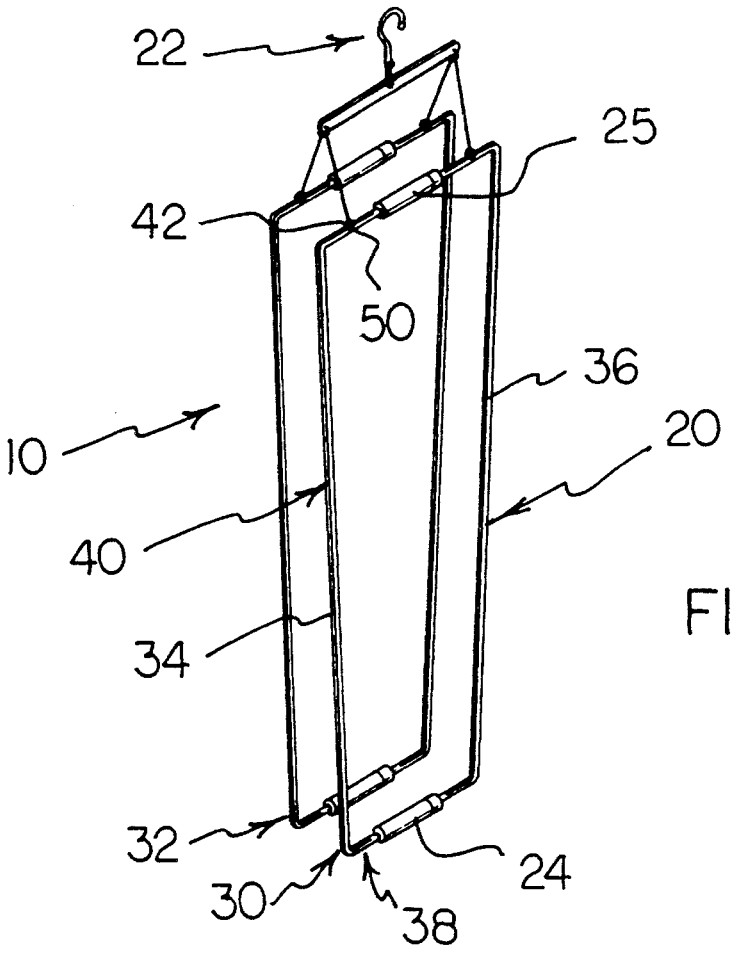
FIG. 3 is a perspective view of the crease keeper showing the side-by-side disposition of wirelike spring loaded frames.

More specifically, it will be noted that the crease keeper 10 comprises a wirelike frame 20 affixed to a hanger 22 and having a plurality of spring loading members 24. Wirelike frame 20 comprises a first expander member 30 and a second expander member 32. See FIGS. 2 and 3. First expander 30 is disposed in one leg of trouserlike garment 12 and second expander 32 is disposed in a second leg of trouserlike garment 12. First expander 30 comprises a pair of generally unequal leg length U-shaped members 34 and 36 of stiff wire composition such as steel wire commonly known as piano wire joining to form first expander 30 at spring loading members 24 and 25. The wire used is generally of rectangular cross section having rounded corners, however, circular cross section wire and triangular cross section wire employment is also feasible. U-shaped member 34 has a first leg portion 38, a central portion 40, and a second leg portion 42. First leg portion 38 comprises a short length of stiff wire affixed at a free end thereof to a first spring loading member 24 and being bent at an obtuse angle 46 to join central portion 40. Central portion 40 comprises an elongated length of stiff rectangular wire joining first leg portion 38 at obtuse angle 46 and joining second leg portion 42 at an acute angle 48 wherein the sum of obtuse angle 46 and acute angle 48 is substantially one hundred eighty degrees. Second leg portion 42 comprises a short length of stiff rectangular wire which is generally equal to or of longer length than first leg portion 38. Second leg portion 42 has a hanger engagement through hole 50 disposed therein.

Figure 4:
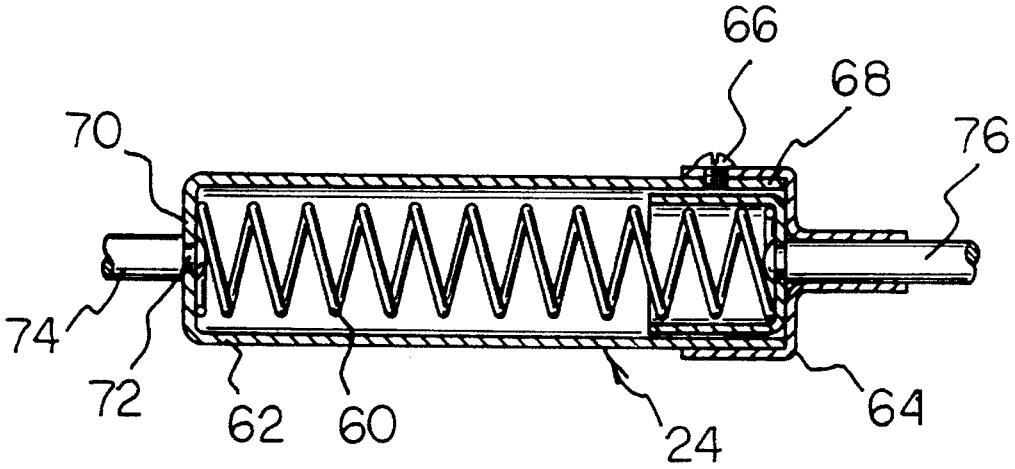
FIG. 4 is a fragmentary side sectional view of the crease keeper showing a compression spring loading member.
Figure 5:
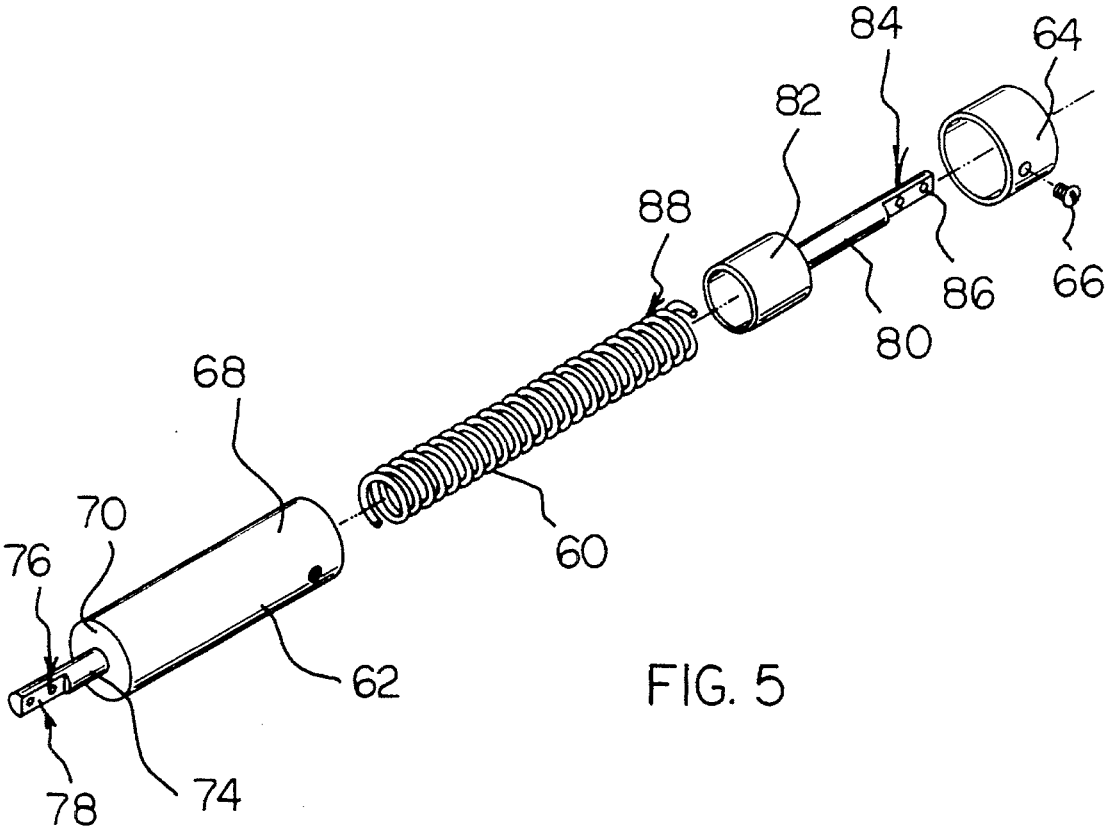
FIG. 5 is a fragmentary exploded perspective view of a crease keeper showing a compression spring loading member.
Figure 6:
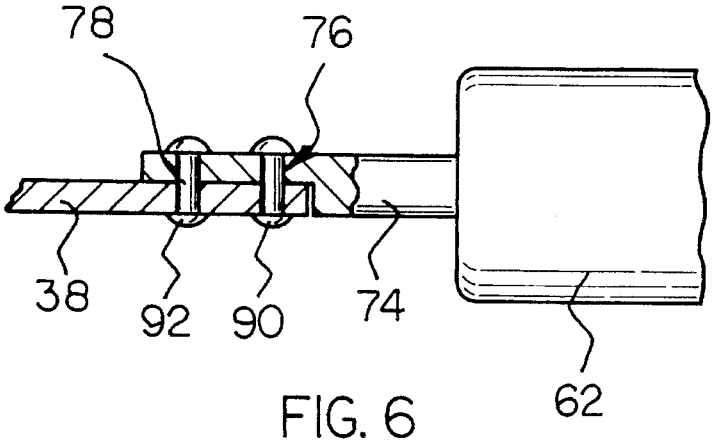
FIG. 6 is a fragmentary perspective view of the crease keeper showing a compression spring loading member fastening means.

First spring loading member 24 comprises a helical compression spring 60 confined to a cartridgelike housing 62 having an end cap closure 64. See FIG. 4. End cap closure 64 slidably engages cartridgelike housing 62 and furthermore is affixed thereto using threaded fastener 66. Cartridgelike housing 62 comprises an elongated cylinder having a circular cross section, a freely opening top 68, and a bottom closure 70 having a central through hole 72 and furthermore is of metallic or polymeric composition. A first interface component 74 is rivetedly affixed to bottom closure 70. First interface component 74 comprises a substantially circular solid cylinder having a flattened portion 76 with a pair of through holes 78 disposed therein. See FIG. 5. A second interface component 80 is rivetedly affixed to cuplike member 82. Second interface component 80 comprises a substantially circular solid cylinder having a flattened portion 84 with a pair of through holes 86 disposed therein. Cuplike member 82 engages compression spring 60 at free end 88 and furthermore cuplike member 82 slidably engages inner walls of cartridgelike housing 62 and a centrally disposed flanged though hole of end cap closure 64 thereby permitting spring force to be transmitted to first expander member 34 and second expander member 30. Transmission of a fraction of spring force to first expander member 34 is provided by engagement of first interface component 74 with first leg portion 38. First interface component 74 is fastened to first leg portion 38 using rivets 90 and 92. See FIG. 6. Similar interface components are provided for the remaining spring loading members and leg portions of first expander 30 and second expander 32.

Figure 7:
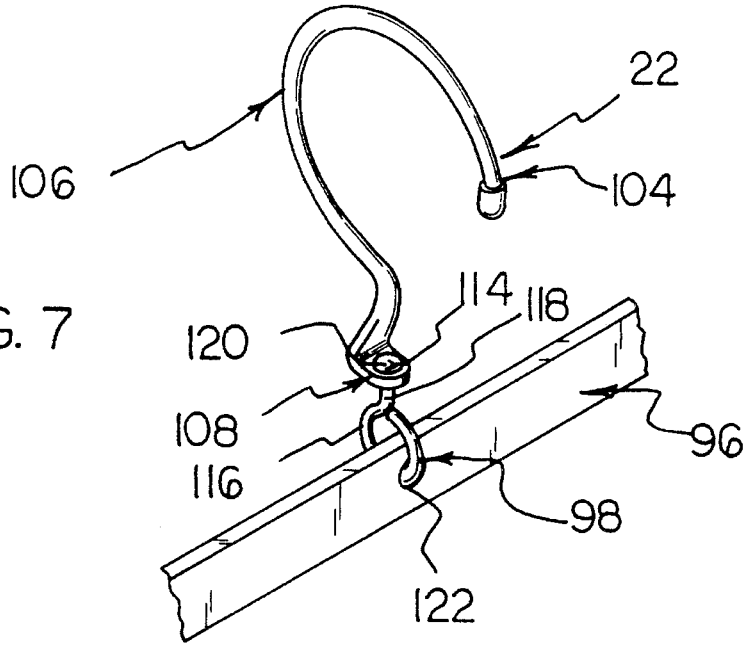
FIG. 7 is a fragmentary perspective view of a crease keeper showing a hooklike hanger.
Figure 8:
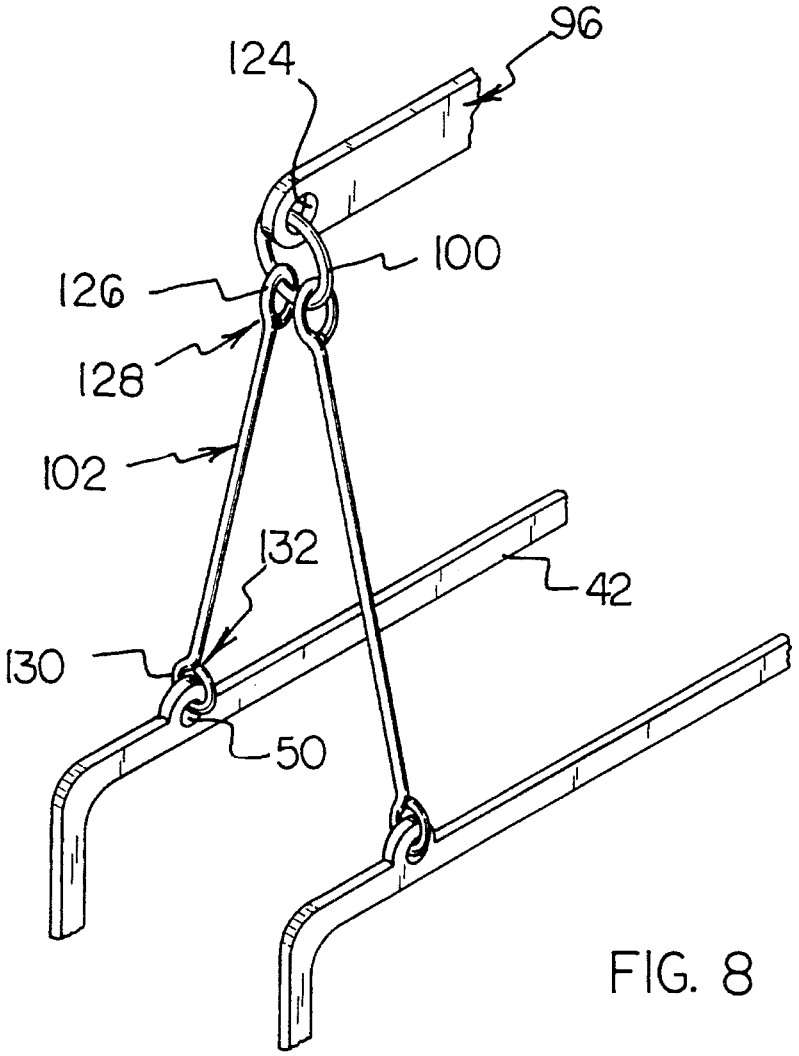
FIG. 8 is a fragmentary perspective view of a crease keeper showing a hanger attachment.

Hanger 22 comprises a hooklike member 94 attached to a spreader bar 96 by a swivel loop attachment 98 and furthermore spreader bar 96 is affixed to first expander member 34 and second expander member 30 using rings 100 and rodlike members 102. Hanger 22 is generally of metallic composition, however, some polymeric materials may be employed provided that sufficient strength is provided to support the heaviest garments of intended disposition thereon. See FIGS. 7 and 8. Hooklike member 94 comprises a first end portion 104, a curving central portion 106, and a second end portion 108. First end portion 104 has a protective rubber or plastic end cap 110 disposed upon a free end thereof. Central portion 106 comprises a smoothly curving substantially semicircular hook susceptible to engaging a variety of existing rodlike and hooklike members generally forming items upon which clothes hangers are disposed in a closet. Second end portion 108 comprises a flattened portion 112 having a normal thereof passing through a suitable point of engagement of the existing rodlike or hooklike members and central portion 106. A through hole 114 is disposed through flattened portion 112 for the purpose of engaging swivel loop attachment 98. Swivel loop attachment 98 comprises a substantially ringlike portion 116 and a substantially straightened portion 118 wherein the substantially straightened portion 118 is disposed through hole 114 and a free end thereof 20 is peened thereby forming an enlarged head thereof which permanently affixes the swivel loop attachment 98 to hooklike member 94. Ringlike portion 116 is permanently affixed to spreader bar 96 by threaded passage through hole 122. Rings 100 comprise substantially circularly formed closed loops threadedly engaging through hole 124 of spreader bar 96 and thereby permanently affixing spreader bar 96 to rodlike members 102 wherein two rodlike members 102 are thus fastened to a singular ring 100. Rodlike members 102 comprise substantially elongated solid rods having a first loop 136 formed at a first end 128 and a second loop 130 formed at a second end 132 thereof. Loop 130 threadedly engages hole 50 disposed upon second leg portion 42.

In an alternate embodiment, spring loading members 24 and 25 are replaced by an elongated inward extension of wirelike frame 20 at a top and bottom thereof wherein the extension provides springlike reflexive action applying force to the trouserlike garment disposed thereon.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention. In as much as the present disclosure includes that contained in the appended claims as well as that of the foregoing description. Although this invention has been described in its preferred forms with a certain degree of particularity, it is understood that the present disclosure of the preferred form has been made only by way of example and numerous changes in the details of construction and combination and arrangement of parts may be resorted to without departing from the spirit and scope of the invention.

What is claimed as being new and desired to be protected by Letters Patent of the United States is as follows:

1. A crease keeper for maintaining a crease in trouserlike garments comprising:

two spring loaded wirelike frame members affixed to a spreader bar by a frame member attachment means, wherein each of the spring loaded wirelike frame members comprise a U-shaped frame pair of stiff wirelike composition, a spring loading means affixed to and providing expansive force to said wirelike frame members, said spring loading means comprising;

a cartridge housing having an elongated cylindrical member with a first rodlike interface member affixed to a substantially closed bottom portion thereof and a caplike member slidably disposed upon a free end of said first elongated cylindrical member and affixed thereon using a threaded fastener, a compression spring member disposed within said cartridgelike housing wherein a first free end of said compression spring member engages said elongated cylindrical member and a second free end of said compression spring member engages a cup like member affixed to a second rodlike interface member wherein said second rodlike interface member slidably engages a flanged centrally disposed hole of said caplike member, and a first interface attachment means for joining said first rodlike interface member and a portion of said wirelike frame member and a second interface attachment means for joining said second interface member and a portion of said wirelike frame member; and a hooklike hanger pivotably affixed to the spreader bar by a swivel loop attachment, said swivel loop attachment having a ringlike portion and a straightened portion with a free end being peened to form an enlarged head which permanently affixes said swivel loop attachment to said hooklike hanger, said hook like member capable of engaging a rodlike member disposed in a closet with said wirelike frame member being disposed within a leg of a trouserlike garment and suspended therefrom.

2. The crease keeper of claim 1 in which each wirelike composition has a first leg portion, a second leg portion, and an elongated central portion wherein said first leg portion being of shorter length than said second leg portion, said first leg portion is disposed at an acute angle with respect to said elongated central portion, said first leg portion having a free end being affixed to a first spring loading means, said second leg portion is disposed at an obtuse angle with respect to said elongated central portion, said second leg portion having a free end being affixed to a second spring loading means, said acute and obtuse angles being supplementary, said first leg portion and said second leg portion being joined at said spring loading means to form said wirelike frame members.

3. The crease keeper of claim 1 in which said first and second interface attachment means comprises a flattened portion having a through hole pair disposed upon a free end of a rodlike interface member and a substantially aligned through hole pair disposed upon a free end of a portion of said wirelike frame member wherein the aligned through hole pairs have rivets disposed therein permanently joining the rodlike interface members to portions of said wirelike frame members.

4. The crease keeper of claim 1 in which said spreader bar has a centrally disposed through hole and a through hole at each free end thereof wherein said centrally disposed through hole engages said ring like portion of a swivel loop attachment and said through holes disposed at each free end thereof having rings therethrough with two rod like members engaging said frame member attachment means.

5. The crease keeper of claim 1 in which said frame member attachment means comprises a ring member and an elongated rodlike member having a substantially closed loop disposed at each free end thereof and furthermore said ring member threadedly engages one substantially closed loop thereof and said second substantially closed loop threadedly engages a through hole disposed upon a portion of said wirelike frame member.

* * * * *